US006740288B2

(12) United States Patent
Ma et al.

(10) Patent No.: US 6,740,288 B2
(45) Date of Patent: May 25, 2004

(54) PROCESS FOR PREPARING A POWDERED W-AL ALLOY

(75) Inventors: Xianfeng Ma, Changchun (CN); Xuewei Yan, Changchun (CN); Wei Zhao, Changchun (CN); Shixue Wu, Changchun (CN)

(73) Assignee: Changchun Institute of Applied Chemistry Chinese Academy of Science, Changchun (CN)

( * ) Notice: Subject to any disclaimer, the term of this patent is extended or adjusted under 35 U.S.C. 154(b) by 0 days.

(21) Appl. No.: 10/173,891

(22) Filed: Jun. 17, 2002

(65) Prior Publication Data

US 2002/0194957 A1 Dec. 26, 2002

(30) Foreign Application Priority Data

Jun. 26, 2001 (CN) ..... 01129545 A

(51) Int. Cl.[7] ..... B22F 1/00
(52) U.S. Cl. ..... 419/32
(58) Field of Search ..... 419/32; 420/430, 420/528

(56) References Cited

U.S. PATENT DOCUMENTS 3,714,702 A * 2/1973 Hammond ..... 29/494
3,785,801 A * 1/1974 Benjamin ..... 75/0.5 BC
4,872,864 A * 10/1989 Branocich et al. ..... 445/50
5,686,676 A * 11/1997 Jech et al. ..... 75/247
6,248,150 B1 * 6/2001 Amick ..... 75/248
6,368,376 B2 * 4/2002 Hong et al. ..... 75/235
6,527,824 B2 * 3/2003 Amick ..... 75/248

OTHER PUBLICATIONS

Yifang Ouyang et al., Science in China, 2000, 43:2, pp. 180–184.

* cited by examiner

*Primary Examiner*—Daniel Jenkins
(74) *Attorney, Agent, or Firm*—Morgan & Finnegan, LLP

(57) ABSTRACT

The present invention relates to a process for preparing a powdered tungsten-aluminum alloy, in which the powdered tungsten and aluminum as starting materials is mechanical alloyed at normal temperature to provide the tungsten-aluminum alloy. The process of this present invention is simple and easy and the device used is simple to handle. The process is carried out at room temperature, and is suitable for preparing an alloy of metals wherein there is large disparity between melting points and densities of the metals, which alloy could not be prepared by the known smelting process.

1 Claim, No Drawings

PROCESS FOR PREPARING A POWDERED W-AL ALLOY

FIELD OF THE INVENTION

The present invention relates to a process for preparing a powdered tungsten-aluminum alloy.

DESCRIPTION OF THE RELATED ART

Tungsten is the No.74 element in the periodic table. It has a high melting point (3410° C.), a high density (19.25 g/cm$^3$), a low thermal coefficient of expansion, a low vapor pressure, and excellent electrical conductivity and heat conductivity. It occupies an important position in high temperature constructional and functional materials. Tungsten is a non-replaceable key material in many fields such as filament luminescence, cathode-ray emission, semiconductor cradle, electrical contact, and in the aerospace industry. Aluminum is characterized by its lightweight, low melting point, good oxidation resistance, excellent electrical conductivity, heat conductivity, and good ductility. For applications wherein, a material with high hardness, high strength, good electrical conductivity, heat conductivity, good oxidation resistance and processability is necessary, it would be desirable to alloy these two metals, to obtain a constructional and functional material with high specific strength, high temperature resistant. Up to the present, there have been many attempts to create the desired materials by alloying metals with a high melting point difference (about 2710° C.) and a high density difference (about 7.1 times). However, it is the high melting point difference and density difference that caused difficulty in the preparation of an alloy of tungsten and aluminum. It has been found that tungsten-aluminum alloys can not be prepared by the conventional technique of alloying by a smelting process.

A process for preparing a tungsten-aluminum alloy is disclosed in Ouyang, Yifang et al, *Research on Mechanical Alloying for Al—W Binary Alloy to Enhance Solid Solubility*, Chinese Science, Div. A, Vol. 30, No. 1 (2000). Ouyang et al. describes a process to obtain tungsten-aluminum alloys by the use of a planetary high-energy ball mill using a mixture of tungsten to aluminum wherein the ratio by weight of Al:W was 0.1, 1 and 4. The alloy obtained has a structure $Al_{1-x}W_x$, wherein x=0.9, 0.5, i.e. $Al_{0.1}W_{0.9}$, and $Al_{0.5}W_{0.5}$. Through a theoretical embedment model, Ouyang had calculated the maximum solid solubility of Al in the alloy as 65.6%. However, no $Al_{0.8}W_{0.2}$ or $Al_{0.9}W_{0.1}$, wherein there is more Al, can be obtained by the Ouyang et al. process. It is known that the difficulty of alloying would significantly increase with the increase in Al content. However, the present inventors believed that an alloy wherein the solid solubility of Al is more than 50% can be produced by improving the technique of synthesis.

SUMMARY OF INVENTION

The object of this invention is to provide a process for preparing a tungsten-aluminum alloy, in which the starting materials, powdered tungsten and aluminum, are mechanical alloyed at a normal temperature.

DETAILED DESCRIPTION OF INVENTION

For an alloy of tungsten and aluminum, $Al_{1-x}W_x$, if the atom ratio of Al:W equals to 1:1, the composition of the alloy is $Al_{0.5}W_{0.5}$. If Al:W equals to 2:1, then the composition of the alloy is $Al_{0.67}W_{0.33}$. If Al:W equals to 3:1, then the composition is $Al_{0.75}W_{0.25}$. If Al:W equals to 6:1, then the composition is $Al_{0.86}W_{0.14}$. At a first glance, it appears that the increase of Al content from $Al_{0.5}W_{0.5}$ to $Al_{0.86}W_{0.14}$ is not large. However, based on the atom ratio, Al:W has increased 6× from 1:1 to 6:1.

The energy required for alloying aluminum to tungsten substantially increases with the increase in Al:W. Generally, the excess unalloyed Al would be forged during synthesis, a major reason why an alloy with a high Al:W ratio could not be prepared by the process described in Ouyang et al.

According to the present invention, an alloy with an atomic ratio of Al:W up to 6:1 can be produced by the use of a vibrating mechanical alloying device, wherein Al is added stepwise during the process to prevent the weld-forging of excess Al. In this process the kinetic energy provided by the simultaneous impinging and rubbing of the balls in the device is transferred to the aluminum and tungsten, ensuring good contact between the two metals, which in turn ensures that the Al atoms on the surface of the metal having good ductility are incorporated into the metal lattice of W, to achieve an alloy having a high Al:W ratio of 6:1.

The process using the vibrating mechanical alloying device provides a high level of energy for synthesis and efficiency. It provides a process that is more favorable for alloying within a short synthesis time and enables the production of alloys with a wider range of Al:W ratios. This is because the main route of energy transferred is macroscopic kinetic energy from mechanical impact.

According to the present invention, an amount powdered tungsten with a particle size <200 mesh, and a purity >99.8%, and an amount of powdered aluminum with a particle size <200 mesh and a purity >99.5% are weighed out on the basis of an alloy composition $W_{1-x}Al_x$, wherein x=0.01–0.86. The powdered tungsten and aluminum are then added to a high energy ball mill (the ratio, ball/metal mixture =10:1–50:1). The ball mill is then provided with an argon atmosphere and sealed. The device iss activated for 4–10 hours to alloy the two metal powders. When x is in the range of 0.55–0.86, an additional amount of powdered Al was added stepwise in several portions to the device to achieve a higher ratio of Al:W.

The tungsten-aluminum alloy obtained by this process was analyzed by X-ray powder diffraction, which showed that the Al atoms have been incorporated completely into W lattice in the alloy and that the resultant alloys, $W_{1-x}Al_x$ (x=0.01–0.86), have the metal structure of tungsten. In addition, electric probe analysis indicated that the distribution of the components is homogeneous and the particle size of the alloy obtained was about 1 $\mu$m. The powdered alloy were sintered into lumps (Φ15 mm) and the micro-hardness of the samples were measured. The micro-hardness was three times as high as that of metallic tungsten, and 5–6 times as high as that of the available high hardness aluminum alloys.

For example, the Vickers hardness of the tungsten alloys obtained with a structure, $W_{0.5}A_{0.5}$, $W_{0.25}Al_{0.75}$ or $W_{0.14}Al_{0.86}$ was 1100, 1210 and 1110 respectively. Each of the alloys obtained has a melting point of more than 1200° C. and a pyro-oxidation resistant temperature significantly exceeding that of metallic tungsten or metallic aluminum. Because alloying is carried out by incorporating Al atoms into the W lattice, the alloy is referred to as a tungsten-aluminum alloy.

A characteristic of this invention is that, good surface contact is ensured for solid phase interaction of two metals with large disparities in their melting points and densities. The surface of the metallic tungsten is alloyed to aluminum by the local, instant and intermitten transfer of energy to bind aluminum atoms to tungsten atoms. The homogenization of the two metals to form the alloy is achieved by providing new contact surface through the randomized motion of the reactants and through the solid phase diffusion within the grains.

The process of this present invention is simple and easy. The device is simple to handle. The process is carried out at room temperature, and is suitable for preparing alloys of metals where there are large disparities between the melting points and densities of the metals. This has not been achievable using the existing smelting process.

EXAMPLES

The present invention is described in more detail by way of the following examples.

Example 1

On the basis of an alloy composition $W_{0.99}Al_{0.01}$, 99.85 g of powdered W (particle size <200 mesh, purity 99.8%) and 0.015 g of powdered Al (particle size <200 mesh, purity 99.5%) were weighed into a high-energy ball mill. After adding 1000 g of steel balls, the mill is provided with an argon atmosphere and sealed. The synthesis is carried out for 4 hr at a vibrating frequency of 1800/min. An alloy with the structure $W_{0.99}Al_{0.01}$ was obtained.

Example 2

On the basis of an alloy composition $W_{0.15}Al_{0.5}$, 87.2 g of powdered W (particle size <200 mesh, purity 99.8%) and 12.8 g powdered Al (particle size <200 mesh, purity 99.8%) were weighed into a high-energy ball mill. After adding 5000 g of steel balls, the mill was provided with an argon atmosphere and sealed. The synthesis was carried out at vibrating frequency of 1800/min for 8 hr. An alloy $W_{0.5}Al_{0.5}$ was obtained.

Example 3

10 g of $W_{0.5}Al_{0.5}$ prepared from example 2 and an additional amount, 2.84 g of powdered Al (for producing $W_{0.45}Al_{0.55}$) were added into a high-energy ball mill. After adding 5000 g of steel balls, the mill was provided with an argon atmosphere and sealed. Synthesis is carried out at a vibrating frequency 1800/min for 12 hr. An alloy $W_{0.45}Al_{0.55}$ was obtained.

Example 4

10 g of $W_{0.5}Al_{0.5}$ prepared from example 2 and an additional amount, 13.17 g of powdered Al to obtain an alloy, $W_{0.33}Al_{0.67}$, were added into a high-energy ball mill. After adding 5000 g of steel balls, the mill was provided with an argon atmosphere and sealed. Synthesis was carried out at a vibrating frequency of 1800/min for 12 hr. An alloy with the structure $W_{0.33}Al_{0.67}$ was obtained.

Example 5

100 g of $W_{0.33}Al_{0.67}$ prepared from example 4 and an additional amount, 10.98 g of powdered Al to produce an alloy with the formula $W_{0.25}Al_{0.75}$, were added into a high-energy ball mill. After adding 5000 g of steel balls, the mill was provided with an argon atmosphere and sealed. Synthesis was carried out at a vibrating frequency of 1800/min for 20 hr. An alloy, $W_{0.25}Al_{0.75}$, was obtained.

Example 6

100 g of $W_{0.25}Al_{0.75}$ prepared from example 5 and an additional amount, 10.19 g of powdered Al to produce an alloy with the formula, $W_{0.2}Al_{0.8}$, were added into a high-energy ball mill. After adding 5000 g of steel balls, the mill was provided with an argon atmosphere and sealed. Synthesis was carried out at a vibrating frequency of 1800/min for 30 hr. A product with the formula $W_{0.2}Al_{0.8}$ was obtained.

Example 7

100 g of $W_{0.2}Al_{0.8}$ prepared from Example 6 and an additional amount, 8.08 g of powdered Al to obtain $W_{0.17}Al_{0.83}$, were added into a high-energy ball mill. After adding 5000 g of steel balls, the mill was provided with an argon atmosphere and sealed. Synthesis was carried out at a vibrating frequency of 1800/min for 35 hr. A product with the formula $W_{0.17}Al_{0.83}$ was obtained.

Example 8

100 g of $W_{0.17}Al_{0.83}$ prepared from Example 7 and an additional amount, 10.67 g of powdered Al to obtain $W_{0.14}Al_{0.86}$, were added into a high-energy ball mill. After adding 5000 g of steel ball, the mill was provided with an argon atmosphere and sealed. Synthesis at a vibrating frequency of 1800/min was carried out for 35 hr. A product with the formula $W_{0.14}Al_{0.86}$ was obtained.

We claim:

1. A process for preparing powdered tungsten-aluminum alloy, comprising the following steps:

adding by weight powdered tungsten of a particle size less than 200 mesh and a purity greater than 99.8% and powdered aluminum of a particle size less than 200 mesh and a purity greater than 99.5% into a high-energy ball mill wherein the ratio of the powdered tungsten to the powdered aluminum is in an atom ratio of W:Al of 0.99 to 0.5, and the ratio by weight of ball/powdered tungsten and powdered aluminum is in the range of 10:1–50:1;

milling the powdered tungsten and powdered aluminum for 4–10 hrs in the ball mill under an argon atmosphere for solid phase synthesis of the tungsten-aluminum alloy;

adding stepwise an additional amount of powdered aluminum in increments during synthesis when the ratio of W:Al is 0.5 to obtain a tungsten-aluminum alloy $W_{1-x}Al_x$, wherein $0.5<x\leqq 0.86$ with a milling time of 20–152 hrs.

* * * * *